US009010434B2

(12) United States Patent
Rocke

(10) Patent No.: US 9,010,434 B2
(45) Date of Patent: Apr. 21, 2015

(54) METHOD FOR CONNECTING TWO COUPLING PARTS OF A SUBSEA COUPLING ARRANGEMENT TO EACH OTHER

(75) Inventor: Svend Erik Rocke, Lier (NO)

(73) Assignee: Vetco Gray Scandinavia AS, Sandvika (NO)

( * ) Notice: Subject to any disclaimer, the term of this patent is extended or adjusted under 35 U.S.C. 154(b) by 100 days.

(21) Appl. No.: 13/462,191

(22) Filed: May 2, 2012

(65) Prior Publication Data

US 2012/0279718 A1 Nov. 8, 2012

(30) Foreign Application Priority Data

May 3, 2011 (NO) ..... 20110660

(51) Int. Cl.

| | |
|---|---|
| ***E21B 7/12*** | (2006.01) |
| ***E21B 43/01*** | (2006.01) |
| ***E21B 17/02*** | (2006.01) |
| ***E21B 33/038*** | (2006.01) |
| ***H01R 13/52*** | (2006.01) |
| ***H01R 13/523*** | (2006.01) |

(52) U.S. Cl.

CPC ..... *E21B 17/028* (2013.01); *E21B 33/0385* (2013.01); *H01R 13/5227* (2013.01); *H01R 13/523* (2013.01)

(58) Field of Classification Search

USPC ..... 166/338, 341, 360, 311, 85.1; 137/15.04, 15.05, 15.06

See application file for complete search history.

(56) References Cited

U.S. PATENT DOCUMENTS

| | | | | |
|---|---|---|---|---|
| 4,073,562 | A * | 2/1978 | Karlskind | 439/199 |
| 4,193,576 | A * | 3/1980 | White | 251/149.6 |
| 4,391,330 | A | 7/1983 | Kiefer | |
| 4,806,114 | A * | 2/1989 | Hopper | 439/191 |
| 4,813,454 | A * | 3/1989 | Smith, III | 137/614.04 |
| 4,949,745 | A * | 8/1990 | McKeon | 137/15.09 |
| 5,022,865 | A * | 6/1991 | Wright et al. | 439/279 |
| 5,834,721 | A * | 11/1998 | Østergaard et al. | 200/81 R |
| 7,080,996 | B2 * | 7/2006 | Ostergaard | 439/188 |
| 2004/0137773 | A1 | 7/2004 | Ostergaard | |
| 2007/0144746 | A1 * | 6/2007 | Jonas | 166/380 |

FOREIGN PATENT DOCUMENTS

| | | | |
|---|---|---|---|
| GB | 2250071 | A | 5/1992 |
| GB | 2342461 | A | 4/2000 |
| WO | 2008100943 | A2 | 8/2008 |

OTHER PUBLICATIONS

Norwegian Search Report dated May 5, 2011, for NO Application 20110660 filed on May 3, 2011.

EP Search Report and Opinion dated Feb. 11, 2014 from corresponding EP Application No. 120020981.4.

* cited by examiner

*Primary Examiner* — Matthew Buck
*Assistant Examiner* — Stacy Warren
(74) *Attorney, Agent, or Firm* — GE Global Patent Operation

(57) ABSTRACT

A method for connecting coupling parts of a subsea coupling arrangement, the coupling parts having at least one sealing surface, in which the coupling parts are connected by displacing the coupling parts towards each other, wherein a watertight seal is formed when the coupling parts are connected, feeding filtered sea water through a channel into a space between the coupling parts during the displacement, flowing the filtered sea water over the sealing surfaces to prevent particles and dirt from being trapped between the sealing surfaces, and discharging the filtered sea water from the space into surroundings of the subsea coupling arrangement.

4 Claims, 3 Drawing Sheets

METHOD FOR CONNECTING TWO COUPLING PARTS OF A SUBSEA COUPLING ARRANGEMENT TO EACH OTHER

BACKGROUND OF THE INVENTION

1. Field of the Invention

Embodiments of the present invention relate to a method for connecting parts to each other and, more particularly, to a method for connecting a first coupling part and a second coupling part of a subsea coupling arrangement to each other.

2. Description of the Prior Art

A subsea coupling arrangement may, for instance, be designed as an electrical connector or a hydraulic connector. A subsea coupling arrangement typically comprises two coupling parts which are to be displaced into contact with each other in order to establish an electric or hydraulic connection. In order to prevent ingress of sea water into the coupling arrangement, the coupling parts are normally provided with sealing surfaces which are adapted to abut against each other to form a watertight seal between the coupling parts when the coupling parts have been connected to each other. When the coupling parts are displaced into contact with each other, there is a risk that particles and/or dirt in the surrounding sea water, such as, for instance, sand or silt, are trapped between the sealing surfaces of the coupling parts. If particles and/or dirt are trapped between the sealing surfaces, the sealing efficiency might be impaired and the sealing surfaces might be damaged. This problem is particularly serious when the sealing surfaces are of metallic material.

BRIEF SUMMARY OF THE INVENTION

According to an embodiment of the present invention, there is provided a method for connecting a first coupling part and a second coupling part of a subsea coupling arrangement to each other, wherein the first coupling part comprises at least one sealing surface configured to abut against at least one corresponding sealing surface of the second coupling part. The method comprising connecting the first coupling part and the second coupling part to each other by displacing the first coupling part and the second coupling part towards each other to bring the at least one sealing surface of the at first coupling part into contact with the at least one corresponding sealing surface of the second coupling part, wherein a watertight seal is formed when the coupling parts are connected to each other, feeding filtered sea water through a channel in one of the first coupling part and the second coupling part into a space between the first coupling part and the second coupling part during the displacement of the first coupling part and the second coupling part towards each other, flowing the filtered sea water over the at least one sealing surface of the first coupling part and the at least one corresponding sealing surface of the second coupling part to prevent particles and dirt from being trapped between the at least one sealing surface of the first coupling part and the at least one corresponding sealing surface of the second coupling part, and discharging the filtered sea water from the space into surroundings of the subsea coupling arrangement.

BRIEF DESCRIPTION OF THE DRAWINGS

The above, as well as additional objects, features and advantages of the present invention, will be better understood through the following illustrative and non-limiting detailed description of the embodiments of the present invention, with reference to the appended drawings, where the same reference numerals will be used for similar elements, wherein.

DETAILED DESCRIPTION OF THE INVENTION

Figure 1:
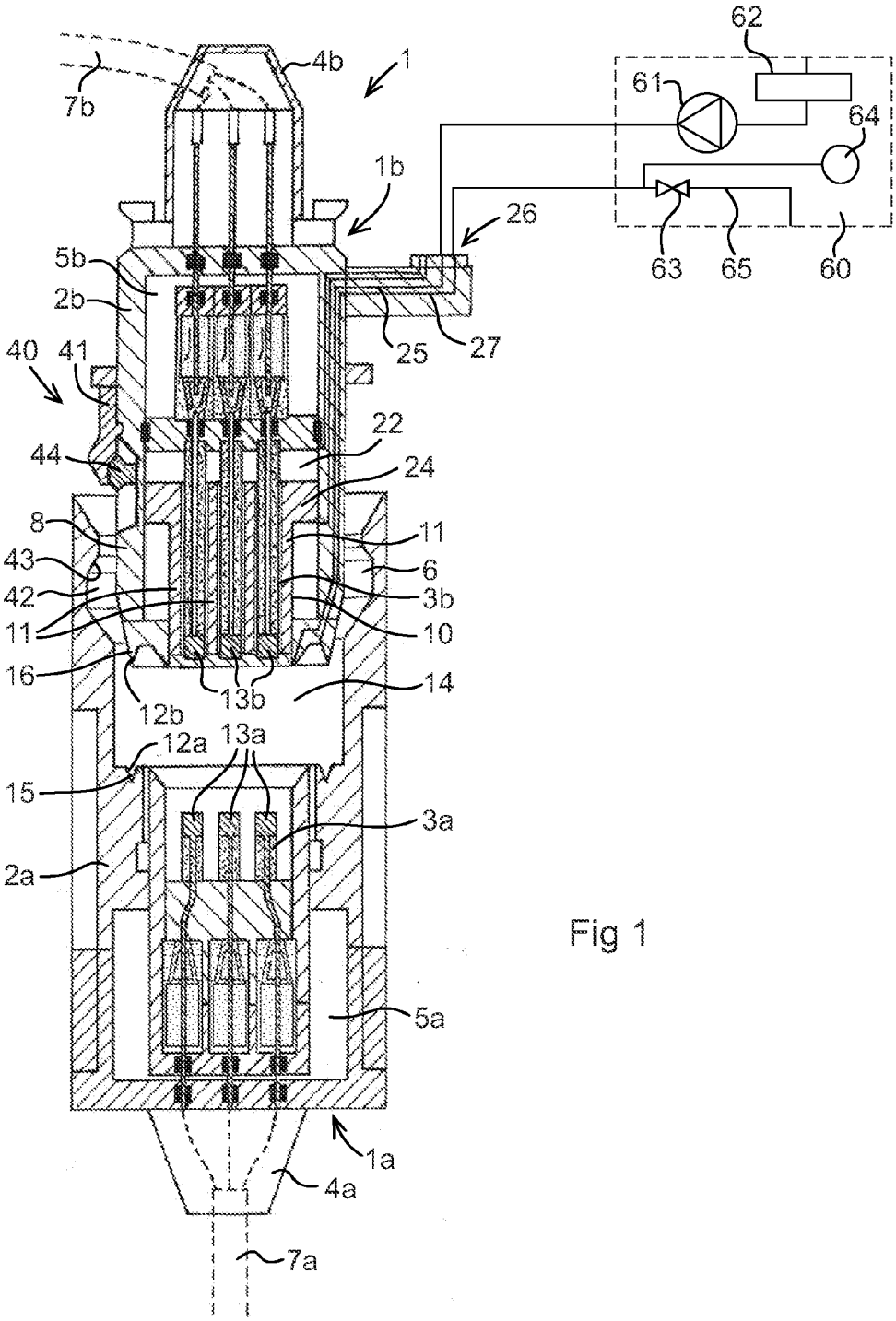
FIGS. 1 and 2 are schematic illustrations of a coupling arrangement, as seen in a longitudinal section during the stage of displacing the coupling parts of the coupling arrangement into engagement with each other according to an embodiment of the present invention.

In the following, the method according to the present invention will be described as used with a subsea coupling arrangement in the form of an electric connector. However, the method may of course also be used with other types of subsea coupling arrangements, such as, for instance, with a subsea coupling arrangement in the form of a hydraulic connector or a stab type electric connector.

FIGS. 1-4 illustrate a coupling arrangement 1 designed for use in subsea electrical power distribution. The coupling arrangement 1 comprises a first coupling part 1*a* and a second coupling part 1*b*, which are removably securable to each other. A first power conduit 7*a* is connectable to the first coupling part 1*a* through attachment 4*a* provided on the first coupling part 1*a* and a second power conduit 7*b* is connectable to the second coupling part 1*b* through attachment 4*b* provided on the second coupling part 1*b*. The two power conduits 7*a*, 7*b* are electrically connectable to each other by means of the coupling arrangement 1. In one embodiment, the respective power conduit 7*a*, 7*b* constitutes a power cable.

Each coupling part 1*a*, 1*b* is provided with a contact housing 2*a*, 2*b* accommodating a respective contact member 3*a*, 3*b*. The coupling parts 1*a*, 1*b* are so designed that a gap 20 (see FIG. 3) is provided between the contact member 3*a* of the first coupling part 1*a* and the contact member 3*b* of the second coupling part 1*b* when the coupling parts 1*a*, 1*b* have been secured to each other. A contact element 10 is displaceably arranged in the contact housing 2*b* of the second coupling part 1*b*. When the coupling parts 1*a*, 1*b* have been secured to each other, the contact element 10 is displaceable towards the contact member 3*a* of the first coupling part 1*a* from a first position, in which no electric connection between the contact member 3*a* of the first coupling part 1*a* and the contact member 3*b* of the second coupling part 1*b* is established by the contact element 10, and into a second position, in which the contact element 10 is establishing electric connection between said contact members 3*a*, 3*b*. In one embodiment, the displacement of the contact element 10 is hydraulically actuated.

The contact members 3*a*, 3*b* are arranged in the respective contact housing 2*a*, 2*b* partly surrounded by a chamber 5*a*, 5*b* filled with dielectric fluid. Compensators (not shown) are suitably arranged in said chambers 5*a*, 5*b* for counter-balancing hydrostatic pressure and for taking care of volumetric compensation in connection with expansion/contraction of the dielectric fluid. In one embodiment, the compensators comprise metallic bellows. In another embodiment, the compensators may also be made of elastomer materials.

In the following, the contact housing 2*a* of the first coupling part 1*a* will be denominated the first contact housing 2*a* and the contact housing 2*b* of the second coupling part 1*b* will be denominated the second contact housing 2*b*. In the same manner, the contact member 3*a* of the first coupling part 1*a* will be denominated the first contact member 3*a* and the contact member 3*b* of the second coupling part 1*b* will be denominated the second contact member 3*b*.

Figure 3:
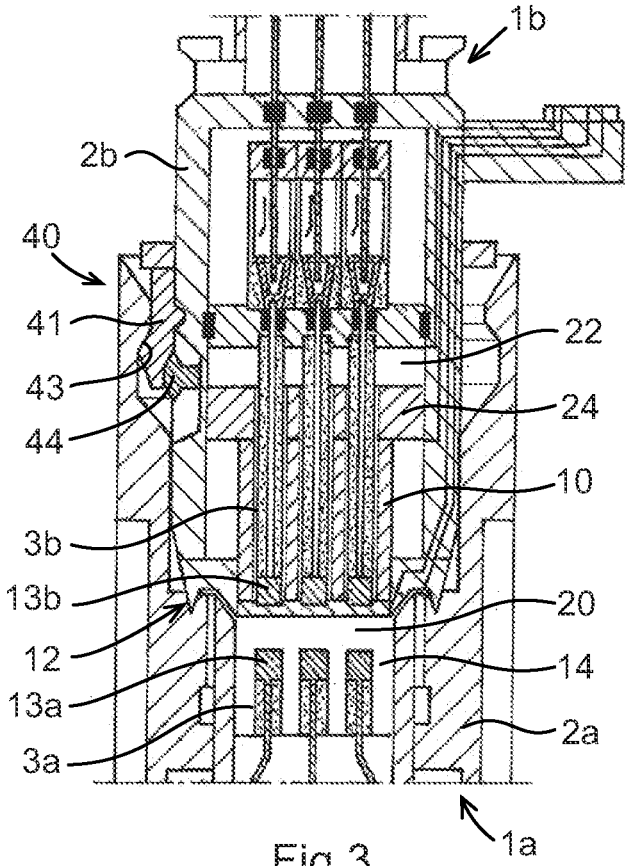
FIG. 3 is a schematic partial view illustrating the coupling arrangement of FIGS. 1 and 2, with the two coupling parts secured to each other according to an embodiment of the present invention.
Figure 4:
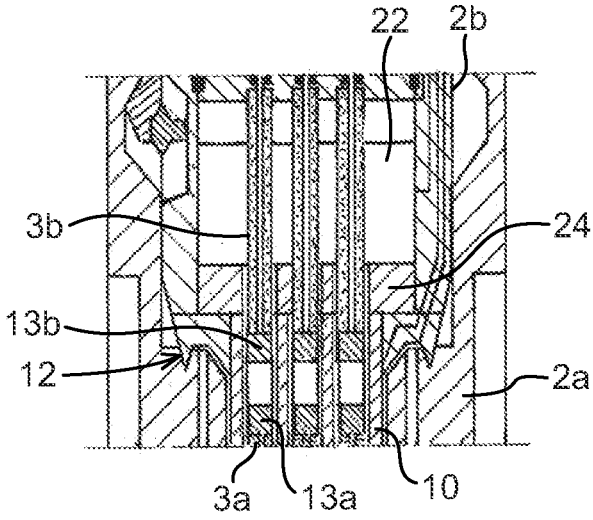
FIG. 4 is a schematic partial view illustrating the coupling arrangement of FIGS. 1-3 after the establishment of electric connection between the contact members of the two coupling parts according to an embodiment of the present invention.

In one embodiment, the respective contact member 3*a*, 3*b* comprises three contact pins 13*a*, 13*b*. The contact element 10 here comprises three contact sleeves 11, each of which being positionable around, and in electric contact with, two opposed contact pins 13*a*, 13*b* of the two contact members 3*a*, 3*b*. The contact sleeves 11 are integrated into one single unit, as illustrated in FIGS. 1-4. The contact element 10 is supported by a piston 24 displaceably mounted in a chamber 22 arranged in the second contact housing 2*b*. Said chamber 22 is filled with dielectric fluid. The piston 24 is configured to be hydraulically actuated so as to achieve the displacement of the contact element 10 between the above-mentioned first and second positions. FIG. 3 shows the contact element 10 when positioned in the above-mentioned first position, i.e. when not establishing any electric connection between the first contact member 3*a* and the second contact member 3*b*. FIG. 4 shows the contact element 10 when positioned in the above-mentioned second position, i.e. when establishing electric connection between the first contact member 3*a* and the second contact member 3*b*.

In one embodiment, the first contact housing 2*a* is positioned with its center axis vertically arranged, as illustrated in FIG. 1. The first coupling part 1*a*, which constitutes a lower coupling part in this embodiment, is, in one embodiment, attached to a foundation structure (not shown) which is secured to a structure placed on a seabed. The second coupling part 1*b*, which constitutes an upper coupling part in this embodiment, is part of typically an electrical drive module. The second coupling part 1*b* is, in one embodiment, configured to be mounted to the first coupling part 1*a* by being lowered down vertically into engagement with the first coupling part 1*a* and demounted from the first coupling part 1*a* by being lifted vertically out of engagement therewith. The lowering and lifting operations are, in one embodiment, carried out by means of a winch device arranged on a ship or on a platform and connected to the electrical drive module, which includes the second coupling part 1*b*, by use of a rope or wire.

In the embodiments shown in FIGS. 1-4, the first contact housing 2*a* has a cavity 6 for receiving an end part 8 of the second contact housing 2*b*. Consequently, the first contact housing 2*a* is designed as a female-like member and the second contact housing 2*b* as a male-like member. In another embodiment, the first contact housing 2*a* can be a male-like member and the second contact housing 2*b* can be a female-like member.

In one embodiment, the coupling arrangement 1 comprises a locking device 40 which is configured to secure the contact housings 2*a*, 2*b* to each other when the coupling parts 1*a*, 1*b* have been properly connected to each other. In one embodiment, the locking device 40 is hydraulically actuated. In one embodiment, the locking device 40 comprises a number of pivotal locking members 41 arranged around the second contact housing 2*b*. These locking members 41 are configured to co-operate with corresponding locking surfaces 43 arranged in a groove 42 in the cavity 6 of the first coupling part 1*a*. A securing member 44 is configured to secure the locking members 41 in the position indicated in FIGS. 3 and 4. The securing member 44 is displaceably arranged in the second coupling part 1*b* and the displacement thereof is hydraulically actuated. The locking members 41 are pivotally mounted to the second coupling part 1*b*. When the securing member 44 is displaced downwards along the second coupling part 1*b* away from the locking members 41, the locking members 41 are free to pivot so as to allow the second coupling part 1*b*, and thereby the second contact housing 2*b*, to move downwards into the cavity 6 of the first coupling part 1*a*.

The first coupling part 1*a* is provided with at least one sealing surface 12*a* which is configured to abut against a corresponding sealing surface 12*b* of the second coupling part 1*b* to form a watertight seal between the coupling parts 1*a*, 1*b* when the coupling parts have been connected to each other. Said sealing surface 12*a* of the first coupling part 1*a* and the corresponding sealing surface 12*b* of the second coupling part 1*b* are brought into contact with each other by displacing the coupling parts 1*a*, 1*b* towards each other. In one embodiment, the sealing surfaces 12*a*, 12*b* are of metallic material. One or more of the sealing surfaces 12*a*, 12*b* of the coupling parts 1*a*, 1*b* may alternatively form part of an elastomeric sealing member. In one embodiment, the sealing surface 12*b* of the second coupling part 1*b* is provided on an annular projection 16 arranged at the lower end of the second contact housing 2*b* and the sealing surface 12*a* of the first coupling part 1*a* is provided in a corresponding recess 15 arranged in the first contact housing 2*a*. The seal 12 formed by the sealing surfaces 12*a*, 12*b* seals the space 14 between the coupling parts 1*a*, 1*b* from the surrounding sea water when the coupling parts 1*a*, 1*b* have been secured to each other.

Figure 2:
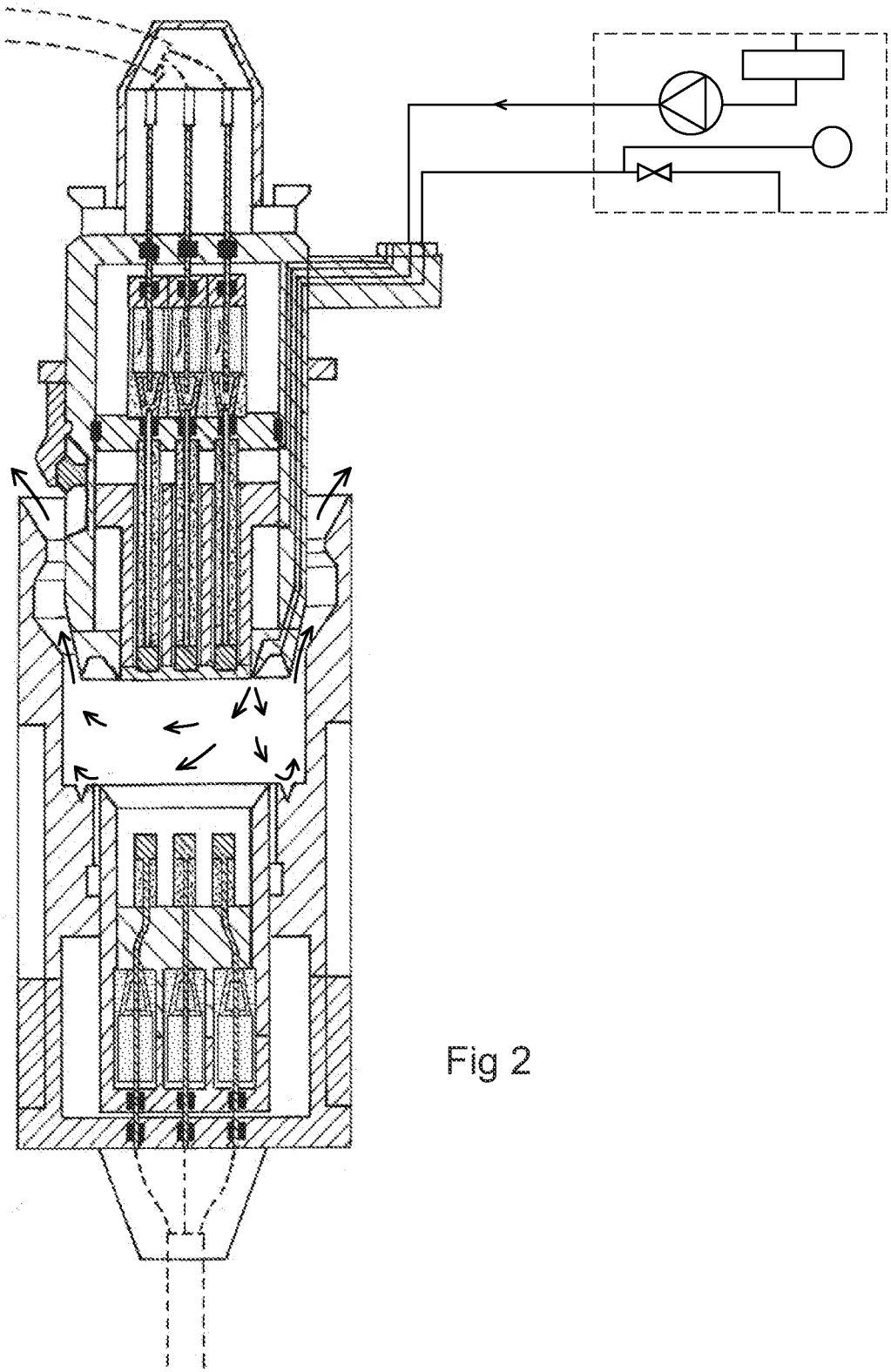

FIGS. 1 and 2 show the coupling arrangement 1 at a stage during the process of connecting the second coupling part 1*b* to the first coupling part 1*a*. The second coupling part 1*b* is connected to the first coupling part 1*a* by being displaced towards the first coupling part 1*a*. During this displacement of the second coupling part 1*b* towards the first coupling part 1*a*, filtered sea water is continuously fed through a channel 25 in the second coupling part 1*b* and into the space 14 between the coupling parts 1*a*, 1*b*, said filtered sea water being discharged from said space 14 and into the surroundings while flowing over the sealing surfaces 12*a*, 12*b* to thereby prevent particles and dirt from being trapped between these sealing surfaces 12*a*, 12*b*. The flow of the filtered sea water is illustrated by the arrows in FIG. 2. Thus, filtered sea water is introduced into the space 14 between the coupling parts 1*a*, 1*b* through the feeding channel 25 and flushed at high speed outwards over the sealing surfaces 12*a*, 12*b* at the same time as the two coupling parts 1*a*, 1*b* are slowly mated together and until the sealing surfaces 12*a*, 12*b* are engaged with each other and the watertight seal 12 is established.

In one embodiment, the filtered sea water is fed into said channel 25 by means of a pump 61 arranged in an Remotely Operated Vehicle 60 (ROV). The ROV 60 is schematically illustrated with broken lines in FIGS. 1 and 2. The pump 61 is connectable to the channel 25 through a hydraulic connection 26 provided on the second coupling part 1*b*. Said sea water is filtered by means of a filter 62 arranged in the ROV 60. When the sealing surfaces 12*a*, 12*b* have been brought into contact with each other (as illustrated in FIG. 3), fluid is allowed to leave the space 14 between the coupling parts 1*a*, 1*b* through a return channel 27 provided in the second coupling part 1*b*. In one embodiment, as illustrated in FIGS. 1 and 2, the return channel 27 is connected to the surroundings through a channel 65 arranged in the ROV 60. A valve 63 is arranged in said channel 65 in the ROV 60. The pressure in the return channel 27, which corresponds to the pressure in the space 14 between the coupling parts 1*a*, 1*b*, can be measured by means of a pressure gauge 64 arranged in the ROV 60. When the sealing surfaces 12*a*, 12*b* have been engaged with each other to form a watertight seal 12 between the coupling parts 1*a*, 1*b*, the valve 63 is closed and the space 14 between the coupling parts

1*a*, 1*b* is pressurized to a given pressure. The sealing efficiency of the seal 12 is checked by monitoring the established pressure in the space 14 by means of the pressure gauge 64. The sealing efficiency of the seal 12 is, for instance, verified by keeping the space 14 closed off after the establishment of said given pressure and monitoring this pressure over a given period of time. If the pressure deviation does not exceed a given value during this period of time, the seal 12 is considered to be acceptable.

FIG. 3 shows the coupling arrangement 1 when the coupling parts 1*a*, 1*b* have been secured to each other in a fluid-tight manner. In the position shown in FIG. 3, the contact element 10 is in the previously mentioned first position, in which no electric connection between the contact member 3*a* of the first coupling part 1*a* and the contact member 3*b* of the second coupling part 1*b* is established by the contact element 10. FIG. 4 shows the contact element 10 positioned in the previously mentioned second position, in which the contact element 10 is establishing electric connection between said contact members 3*a*, 3*b*.

As appears from FIG. 3, there is a gap 20 between the first contact member 3*a* and the second contact member 3*b* when the coupling parts 1*a*, 1*b* have been secured to each other. This gap 20 and the other space 14 between the coupling parts 1*a*, 1*b* is initially filled with filtered sea water. When the coupling parts 1*a*, 1*b* have been secured to each other in a fluid-tight manner, the filtered sea water is flushed out of the space 14 between the coupling parts 1*a*, 1*b*, whereupon the space 14 is filled with dielectric fluid.

In one embodiment, the coupling arrangement 1 could be used for coupling together two power conduits in the form of power cables. However, in other embodiments, the coupling arrangement could also be used for coupling together a first power conduit in the form of a power cable and a second power conduit constituting another type of power conduit than a power cable or coupling together two power conduits constituting types of power conduits other than power cables. One of said power conduits could, for instance, be an input terminal or an output terminal of an electrical appliance.

The present invention is not in any way restricted to the embodiments described above. On the contrary, many possibilities to modifications thereof will be apparent to a person with ordinary skill in the art without departing from the basic idea of the present invention such as defined in the appended claims.

What is claimed is:

1. A method for connecting a first coupling part and a second coupling part of a subsea coupling arrangement to each other, wherein the first coupling part comprises at least one sealing surface configured to abut against at least one corresponding sealing surface of the second coupling part, the method comprising:

connecting the first coupling part and the second coupling part to each other by displacing the first coupling part and the second coupling part towards each other to bring the at least one sealing surface of the first coupling part into contact with the at least one corresponding sealing surface of the second coupling part, wherein a watertight seal is formed when the coupling parts are connected to each other;

feeding filtered sea water through a channel in one of the first coupling part and the second coupling part into a space between the first coupling part and the second coupling part during the displacement of the first coupling part and the second coupling part towards each other;

flowing the filtered sea water over the at least one sealing surface of the first coupling part and the at least one corresponding sealing surface of the second coupling part to prevent particles and dirt from being trapped between the at least one sealing surface of the first coupling part and the at least one corresponding sealing surface of the second coupling part; and prior to connection between the first coupling part and the second coupling part, discharging the filtered sea water from the space directly into surroundings of the subsea coupling arrangement through an annular gap defined by an outer surface of the first coupling part and an inner surface of the second coupling part, wherein filtered sea water remaining in the space after connection between the first coupling part and the second coupling part is discharged through a return channel in one of the first coupling part and the second coupling part, and wherein the filtered sea water is fed into the channel by a pump arranged in a Remotely Operated Vehicle.

2. The method according to claim 1, wherein sea water is filtered by a filter arranged in the Remotely Operated Vehicle.

3. The method according to claim 1, wherein the return channel comprises a valve, and wherein the space between the first coupling part and the second coupling part is connected to the surroundings of the subsea coupling arrangement by the return channel, the method further comprising:

monitoring the pressure in the space after the connection of the first coupling part and the second coupling part to each other while the valve is closed to check the sealing efficiency of the watertight seal.

4. The method according to claim 1, further comprising:

flushing the space between the first coupling part and the second coupling part free of filtered sea water; and filling the space between the first coupling part and the second coupling part with dielectric fluid after the connection of the first coupling part and the second coupling part to each other.

* * * * *